US005729275A

United States Patent [19]

Nagahata

[11] Patent Number: 5,729,275

[45] Date of Patent: Mar. 17, 1998

[54] THERMAL PRINTHEAD, DRIVE IC FOR THE SAME AND METHOD FOR CONTROLLING THE THERMAL PRINTHEAD

[75] Inventor: Takaya Nagahata, Kyoto, Japan

[73] Assignee: Rohm Co. Ltd., Kyoto, Japan

[21] Appl. No.: 556,967

[22] PCT Filed: Apr. 13, 1995

[86] PCT No.: PCT/JP95/00723

§ 371 Date: Dec. 7, 1995

§ 102(e) Date: Dec. 7, 1995

[87] PCT Pub. No.: WO95/28283

PCT Pub. Date: Oct. 26, 1995

[30] Foreign Application Priority Data

| | | | |
|---|---|---|---|
| Apr. 15, 1994 | [JP] | Japan | 6-077671 |
| Oct. 3, 1994 | [JP] | Japan | 6-239281 |
| Oct. 6, 1994 | [JP] | Japan | 6-281094 |
| Oct. 6, 1994 | [JP] | Japan | 6-281096 |

[51] Int. Cl.[6] ..... B41J 2/34

[52] U.S. Cl. ..... 347/210; 347/182; 347/209

[58] Field of Search ..... 347/182, 188, 347/190, 209, 210, 211

[56] References Cited

U.S. PATENT DOCUMENTS

| | | | |
|---|---|---|---|
| 5,097,271 | 3/1992 | Lee et al. | 347/209 |
| 5,223,855 | 6/1993 | Ota et al. | 346/76 |
| 5,241,326 | 8/1993 | Tagashira | 347/205 |
| 5,412,405 | 5/1995 | Nureki et al. | 347/182 |
| 5,532,723 | 7/1996 | Nagahata et al. | 347/209 |
| 5,543,828 | 8/1996 | Minowa | 347/211 |

FOREIGN PATENT DOCUMENTS

| | | | |
|---|---|---|---|
| 0 243 998 A1 | 4/1987 | European Pat. Off. . | |
| 0 491 401 A1 | 6/1992 | European Pat. Off. . | |
| 0 535 557 A1 | 7/1993 | European Pat. Off. . | |
| 2 702 600 | 9/1994 | France . | |
| 61-102862 | 5/1986 | Japan | H04N 1/032 |
| 62-28260 | 2/1987 | Japan | B41J 3/20 |
| 62-92865 | 4/1987 | Japan | B41J 3/20 |
| 62-292060 | 12/1987 | Japan | H04N 1/032 |
| 3278967 | 12/1991 | Japan | B41J 2/355 |

*Primary Examiner*—Stuart N. Hecker

*Attorney, Agent, or Firm*—Michael D. Bednarek; Kilpatrick Stockton LLP

[57] ABSTRACT

According to the present invention, a plurality of drive ICs (7) are mounted on a thermal printhead (1) which has a predetermined number of heating dots (3). The number of output bits of each drive IC (7) is set to be a divisor of ¼ of the predetermined number of the heating dots (3) and a multiple of 8 which is no less than 48. Thus, it is possible to divide the plurality of drive ICs (7) into 2 or 4 groups and to control the groups of drive ICs by time division. Further, when the number of output bits of each drive IC (7) is set to be a common divisor of ¼ and ⅓ of the predetermined number of the heating dots (3), it is possible to drive the thermal printhead (1) by 3-divisional control in addition to 2- and 4-divisional control. Specifically, the number of output bits of each drive IC (7) is preferably any one of 72, 144 or 216, in particular 144.

19 Claims, 10 Drawing Sheets

THERMAL PRINTHEAD, DRIVE IC FOR THE SAME AND METHOD FOR CONTROLLING THE THERMAL PRINTHEAD

TECHNICAL FIELD

The present invention relates to a thermal printhead and a drive IC therefor. The present invention also relates to a method for controlling the thermal printhead.

BACKGROUND ART

A thermal printhead used for a thermosensitive printing unit of a facsimile machine for example is designed such that a plurality of heating dots arranged in a line on an insulating head substrate are actuated for heating by drive IC arranged in an array. In the case of a so-called thick film thermal printhead, a linear heating resistor is formed on a head substrate by printing for example, whereas a common electrode having comb-like teeth is formed in parallel to the linear heating resistor with the comb-like teeth of the common electrode extending under the heating resistor. Heating dots are divisionally provided by portions of the heating resistor which are located between the comb-like teeth of the common electrode. Each heating dot is electrically connected to an end of an individual electrode. The other end of the individual electrode is electrically connected to a corresponding output pad of a relevant drive IC by wire bonding. The drive IC causes its output pads to be selectively turned on according to printing data. An electric current flows between the individual electrode corresponding to the turned-on output pad and the common electrode, thereby driving a desired heating dot for heating.

When printing on A4-size paper at a printing density of 200 dpi (8 dots in 1 mm) for example, 1728 heating dots are to be formed. At present, it is difficult to drive all of the heating dots by a single IC chip because of limitations in manufacturing semiconductors for example. Therefore, a plurality of IC chips are mounted on the head substrate, and each of the drive ICs is assigned to a predetermined number of heating dots for driving thereof. The respective drive ICs incorporate a shift register having a predetermined number of bits which corresponds to the number of output pads. The data-out pad of each drive IC and the data-in pad of another are connected in cascade, so that all shift registers are in substantial succession. When performing an A4-size printing, printing data comprise 1728 bits for one line. The printing data corresponding to the one line are serially fed to the data-in pad of a drive IC, which is located at an end. According to the 1728-bits printing data thus stored in the shift registers, the respective output pads are turned on or off in response to strobe signals fed to the respective drive ICs.

Basically, the number of output bits of a drive IC for a thermal printhead of this type is preferably a multiple of 8 bits for purpose of convenience in transmitting data between the drive ICs for example. In practice, the number of bits for a prior art drive IC is, for example, 32, 64, 96, or 128 bits which is simply a multiple of 32 bits. The number of bits for one chip has gradually increased due to the ability for high integration of ICs.

Usually, the 1728 bits are driven for printing according to the printing data for one line by time division but not simultaneously. This is because the amount of current passing through the common electrode becomes large if all of the 1728 dots are heated, so that the voltage drop along the common electrode circuit becomes remarkable to cause disadvantages, such as printing irregularities while requiring the use of a large capacity power source, which may increase the cost.

Therefore, after input of the 1728-bits printing data, strobe signals for controlling printing timings are fed, for example, with time difference respectively to those drive ICs assigned to the left half heating dots and to those drive ICs assigned to the right half heating dots.

For instance, twenty-seven 64-bits drive ICs are used to make an A4-wide 1728-dots thermal printhead. In this case, when printing is performed by 2-divisional control, the drive ICs must be divided, for example, into a left-side group having 13 drive ICs and a right-side group having 14 drive ICs, thereby providing different numbers of dots in the respective divided groups. This may cause printing irregularities and necessitate a power source with a capacity enough for the 14 drive ICs assigned to a corresponding number of heating dots. Thus, the capacity of the power source is wasteful for those of the heating dots taken care of by the 13 drive ICs.

Furthermore, it is also conceivable to perform a 4-divisional printing control in order to realize an additional size reduction of the printing unit, chiefly through an additional capacity reduction of the power source. In this case again, since 27 cannot be divided by 4 without a remainder, the same problems as described above for 2-divisional control may also occur.

In addition to the above-described printing unit incorporating an 8 inch thermal printhead which generally corresponds to A4-size, recently put to practical use are 2-inch terminal printers used in cash register or in railroad vehicles for example, 3-inch terminal printers used to calculate gas charges or water charges or the like, 4-inch terminal printers used for medical appliances, and 10-inch printers. Among these printers, the 2-inch printer, for example, needs about 400 heating dots. In a similar manner, each of the 3-inch, 4-inch and 10-inch printers need a predetermined number of heating dots corresponding to the relevant size. Therefore, in order to perform proper printing with a small power source, each of the different printers incorporating a different number of drive ICs requires driving control like the divisional control described above.

In reality, however, no specific means has been hitherto found to provide proper interchangeability in making each of the variously sized printers by mounting a single type of drive ICs. For example, in the case of using a plurality of 64-bits drive ICs to make 2-inch, 3-inch, 4-inch, 8-inch and 10-inch printers, each of these printers suffers difficulty in performing uniform divisional control or other drive control if the total number of output bits of the drive ICs is made to correspond to the number of heating dots of the printer, as described above.

DISCLOSURE OF THE INVENTION

An object of the present invention is to enable proper printing by suitable 2-, 3- or 4-divisional control particularly with respect to an A4-size 1728-bits thermal printhead.

Another object of the present invention is to enable the use of identical drive ICs for making variously sized thermal printheads while simplifying their drive control as much as possible.

According to the present invention there is provided a drive IC for mounting on a thermal printhead having a predetermined number of heating dots, wherein the drive IC has output bits in a number which is set to be both a divisor of ¼ of the predetermined number of the heating dots and a multiple of 8 no less than 48.

Applying the present invention to an A4-size thermal printhead having 1728 heating dots for example, ¼ of the total number of the heating dots is 432. Numbers which correspond to a divisor of 432 and a multiple of 8 are 8, 16, 22, 28, 72, 144, 216 and 432. According to the present invention, 16 and 24 are excluded because ICs with such a small number of output bits are impractical at the present time where high integration is realized. Therefore, drive ICs which have 48, 72, 144, 216 and 432 output bits fall within the scope of the present invention.

432 which is ¼ of 1728 is a divisor of 864 which is ½ of 1728. Therefore, when an A4-size thermal printhead having 1728 heating dots is made by using a plurality of drive ICs having one of the above-mentioned output bit numbers (48, 72, 144, 216 and 432), 2-divisional control as well as 4-divisional control can be properly performed in the following manner.

In the case of using 144-bits ICs for example, the number of drive ICs is 12 which is obtained by 1728÷144. 12 can be divided by 2 or 4 without a remainder. Therefore, when 2-divisional control is performed, the drive ICs are divided into two groups which include a left-side group of 6 drive ICs and a right-side group of 6 drive ICs. Strobe signals are supplied to the respective groups at different timings. Thus, 1728 heating dots are actuated time-divisionally by dividing the entire heating dots into the left-side 864 dots and the right-side 864 dots.

When divide-by-four time-divisional control is performed, 12 drive ICs are divided into four groups each of which comprises 3 drive ICs, and strobe signals are supplied to the respective groups at different timings. In this way, 1728 heating dots can be actuated by 4-divisional control wherein the respective groups of 432 dots are heated one after another starting from the left side for example.

The number of heating dots in the respective divided groups is equal regardless of whether 2-divisional or 4-divisional control is adopted. Therefore, the current capacity needed for printing in the divided groups of heating dots is equalized, so that the voltage drop along the common electrode under a printing condition is also equalized. As a result, irregularities of printing will not occur due to different printing intensities in the different divided groups. Further, the current capacity of the power source may not be wasted for any of the groups.

According to a preferred embodiment of the present invention, the number of output bits of the drive ICs is a common divisor of ¼ and ⅓ of the total number of heating dots. Applying this embodiment again to an A4-size thermal printhead which has 1728 heating dots, common divisors for 432 which is ¼ of 1728 and for 576 which is ⅓ of 1728 are 16, 24, 48, 72 and 144 which are also multiples of 8. Of these numbers, 16 and 24 should be excluded for the same reason as described already. Therefore, drive ICs having 48, 72 and 144 bits fall within the scope of the preferred embodiment. According to this embodiment, 3-divisional printing control can be also performed properly.

Considering the case of using 144-bits drive ICs similarly to the above, 12 drive ICs may be divided into three groups each of which comprises four drive ICs. By supplying strobe signals to these three groups of four drive ICs at different timings, the 1728 heating dots for one line can be actuated by 3-divisional control wherein the three groups of 576 dots are heated one after another starting from the left side for example. Since the number of heating dots in the divided groups are equal, it is possible to prevent irregular printing while setting the capacity of the power source as small as possible to avoid waste, as described above.

The present invention also provides the thermal printhead which incorporates a plurality of drive ICs each having the above-described arrangement as well as a method for controlling the thermal printhead.

For example, by using three or four 144-bits drive ICs, it is possible to easily make a relatively small thermal printhead. In the same way, it is also possible to progressively increase the size of thermal printhead by increasing the number of 144-bits drive ICs to 6, 12 or 14.

Thus, 144-bits drive ICs can be used not only for enabling proper divisional control of a thermal printhead, but also for providing thermal printheads of various sizes. As a result, by realizing standardization, advantages can be obtained in terms of the cost in addition to facilitating the manufacture of thermal printheads.

When the dot density of the heating dots of the thermal printhead is set at 200 dpi, the total number of output bits provided by three 144-bits drive ICs properly corresponds to the number of heating dots needed for a 2-inch size printhead. The total number of output bits provided by four 144-bits drive ICs properly corresponds to the number of heating dots needed for a 3-inch size printhead. The total number of output bits provided by six 144-bits drive ICs properly corresponds to the number of heating dots needed for a 4-inch size printhead.

Further, the total number of output bits provided by fourteen 144-bits drive ICs properly corresponds to the number of heating dots needed for a 10-inch size printhead. Thus, the above-described drive ICs are useful for such a printhead. In this case, further, the drive ICs can be divided into two groups each including 7 drive ICs, thereby realizing proper 2-divisional control.

Other features and advantages of the present invention will become apparent from the following detailed description of the preferred embodiments given with reference to the accompanying drawings.

BEST MODE FOR CARRYING OUT THE INVENTION

The preferred embodiments of the present invention will be described below with reference to the accompanying drawings.

Figure 1:
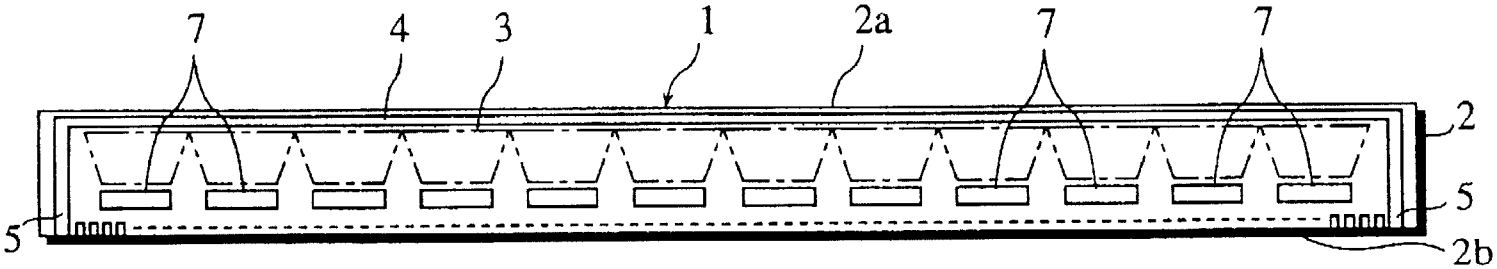
FIG. 1 is a schematic plan view showing the arrangement of a thermal printhead according to an embodiment of the present invention.

FIG. 1 is a plan view schematically showing the construction of a thick film-type thermal printhead. An elongate head substrate 2 has an upper surface formed with a linear heating resistor 3 along one longitudinal edge 2*a* of the head substrate, and drive ICs 7 along the other longitudinal edge 2*b*. A common electrode 4 is formed in a strip region between the linear heating resistor 3 and the longitudinal edge 2*a* of the head substrate 2. Each end portion of the common electrode 4 extends to the other longitudinal edge 2*b* of the head substrate 2 to provide a common-electrode connection terminal 5.

Figure 2:
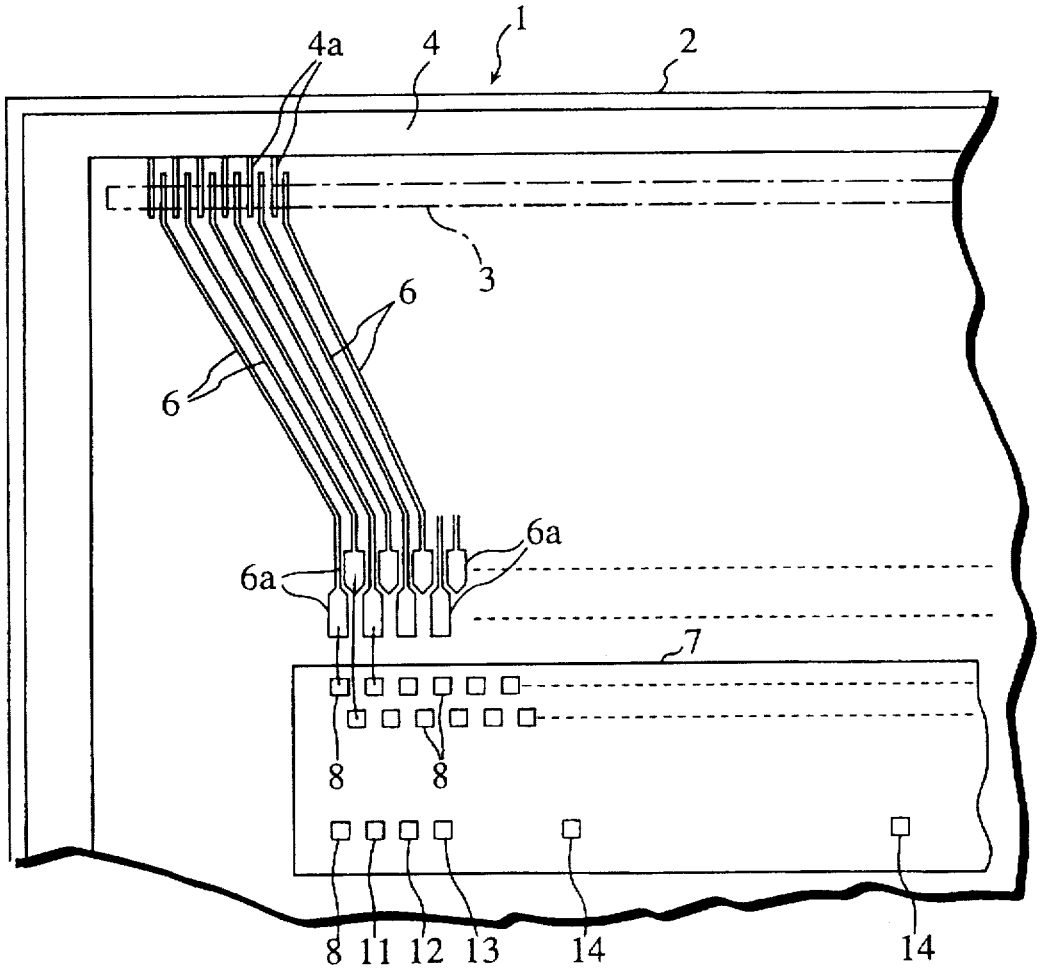
FIG. 2 is an enlarged fragmentary plan view showing the thermal printhead of FIG. 1.

As shown in detail in FIG. 2, the common electrode 4 has a multiplicity of longitudinally spaced comb-like teeth 4*a*. On the other hand, individual electrodes 6 extend, each at one end, in between the comb-like teeth 4*a* of the common electrode 4. The other end of each individual electrode 6 extends to a portion adjacent to a relevant drive IC 7 to form a wire bonding pad 6*a*.

The linear heating resistor 3, as indicated by phantom lines in FIG. 2, is formed to overlap the comb-like teeth 4*a* of the common electrode 4 and the individual electrodes 6 extending between the comb-like teeth, so that heating dots are formed between the comb-like teeth 4*a*. Thus, when each of the individual electrodes 6 is turned on, an electric current passes through a portion (heating dot) of the heating resistor 3 which is positioned between the two comb-like teeth 4*a* which are on both sides of that particular individual electrode 6.

When printing at 200 dpi (200 dots/inch), the pitch between the respective heating dots is 0.125 μm. As previously described, when printing is performed on A4-size paper, 1728 of such heating dots are arranged in a line.

Figure 3:
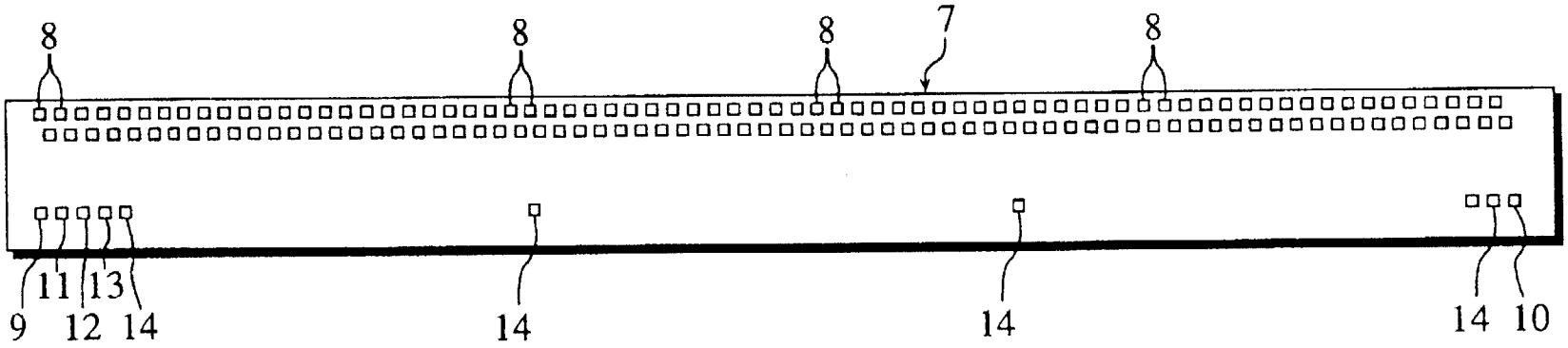
FIG. 3 is an enlarged plan view showing an example of drive IC used for the thermal printhead of FIG. 1.

In the present embodiment, each drive IC 7 has 144 bits. Specifically, as shown in FIG. 3, the drive IC 7 has 144 output pads 8 disposed in a staggered arrangement on the upper face of the drive IC adjacent to one longitudinal edge thereof. Further, as shown in FIG. 3, the upper face of the drive IC 7 is provided with a data-in pad 9, a data-out pad 10, a clock pulse input pad 11, a strobe pad 12, a logic power supply pad 13 and ground pads 14 adjacent to the other longitudinal edge of the drive IC.

The drive IC 7 has a built-in 144-bits shift register which corresponds to the output pads 8. When a strobe signal is supplied to the strobe pad 12, those of the output pads 8 which are selected according to the printing data stored in the shift register are turned on to thermally actuate the corresponding heating dots.

As described above, each of the drive ICs 7 has 144 bits. Therefore, for constituting the A4-size thermal printhead of FIG. 1 having 1728 heating dots, 12 of such drive ICs 7 are mounted on the head substrate 2 (see FIG. 1). As shown in FIG. 2, the output pads 8 of the respective drive ICs 7 and the wire bonding pads 6*a* of the individual electrodes 6 are connected by wire bonding in a known manner. Further, the clock pulse input pad 11, strobe pad 12, logic electric source pad 13 and ground pads 14 of the respective drive ICs are respectively connected to a clock signal wiring pattern (not shown), a strobe signal wiring pattern (not shown), a logic power supply wiring pattern (not shown) and a ground wiring pattern (not shown) by wire bonding.

The data-in pad 9 (see FIG. 3) of the drive IC 7 located at the left extremity in FIG. 1, for example, is wire-bonded to a wiring pattern having a data-in terminal mounted on the head substrate 2. In this case, the data-out pad 10 of the drive IC 7 at the right extremity in FIG. 1 is wire-bonded to a wiring pattern having a data-out terminal mounted on the head substrate 2. Between each two adjacent drive ICs 7, the data-out pad 10 of one drive IC is connected to the data-in pad 9 of the other drive IC 7 through a wiring pattern (not shown) on the head substrate 2 by wire bonding. Thus, it follows that all of the drive ICs 7 (i.e., the shift registers incorporated therein) are connected in cascade for data input and output.

The 1728-bits printing data for one line are stored in the shift registers, 1728 bits in total, connected in cascade as described above. A printing drive is performed in timed response to a strobe signal fed to the strobe pad 12. Normally, all of the heating dots are not actuated simultaneously, but they are divided into plural groups for time-divisional driving.

Figure 1A:
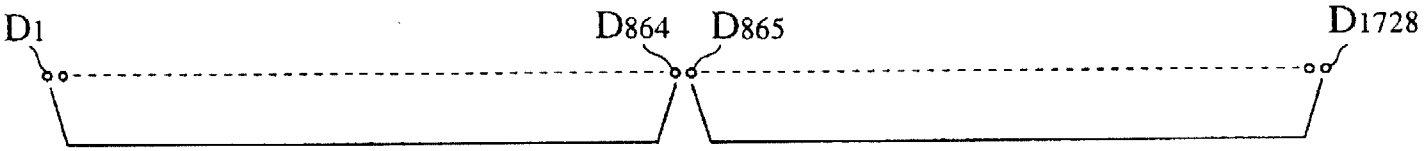
FIGS. 1*a*–1*c* are views respectively illustrating how the thermal printhead of FIG. 1 is driven by 2-divisional, 3-divisional and 4-divisional control.
Figure 1B:
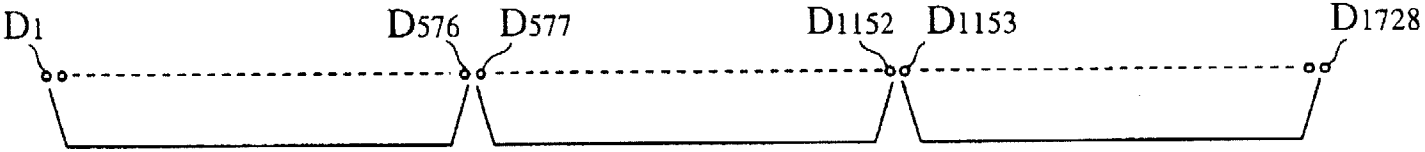

FIG. 1*a* schematically shows a case where 1728 heating dots are divided into two groups of 864 dots for divisional actuation. Similarly, FIG. 1*b* schematically shows a case where the heating dots are divided into three groups of 576 dots for time-divisional actuation, whereas FIG. 1*c* schematically shows a case where the heating dots are divided into four groups of 432 dots for time-divisional actuation.

For example, when performing the 2-divisional control shown in FIG. 1*a*, the strobe pads 12 (see FIGS. 2 and 3) of the 6 lefthand drive ICs 7 out of the 12 drive ICs 7 are commonly connected to a first strobe signal wiring pattern (not shown), whereas the strobe pads 12 of the 6 righthand drive ICs 7 are commonly connected to a second strobe signal wiring pattern (not shown).

Similarly, when performing the 3-divisional control (FIG. 1*b*), three strobe signal wiring patterns are needed. When performing the 4-divisional control (FIG. 1*c*), four strobe signal wiring patterns are needed.

Figure 1C:
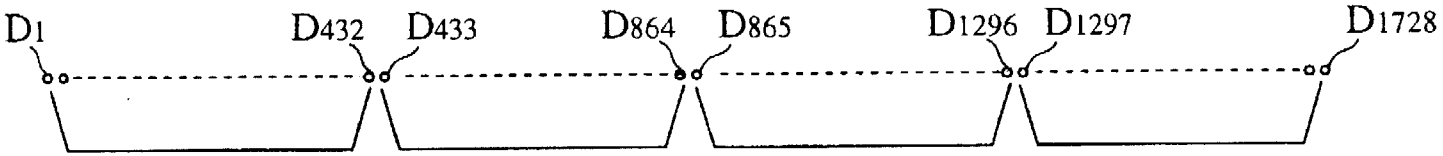
Figure 4:
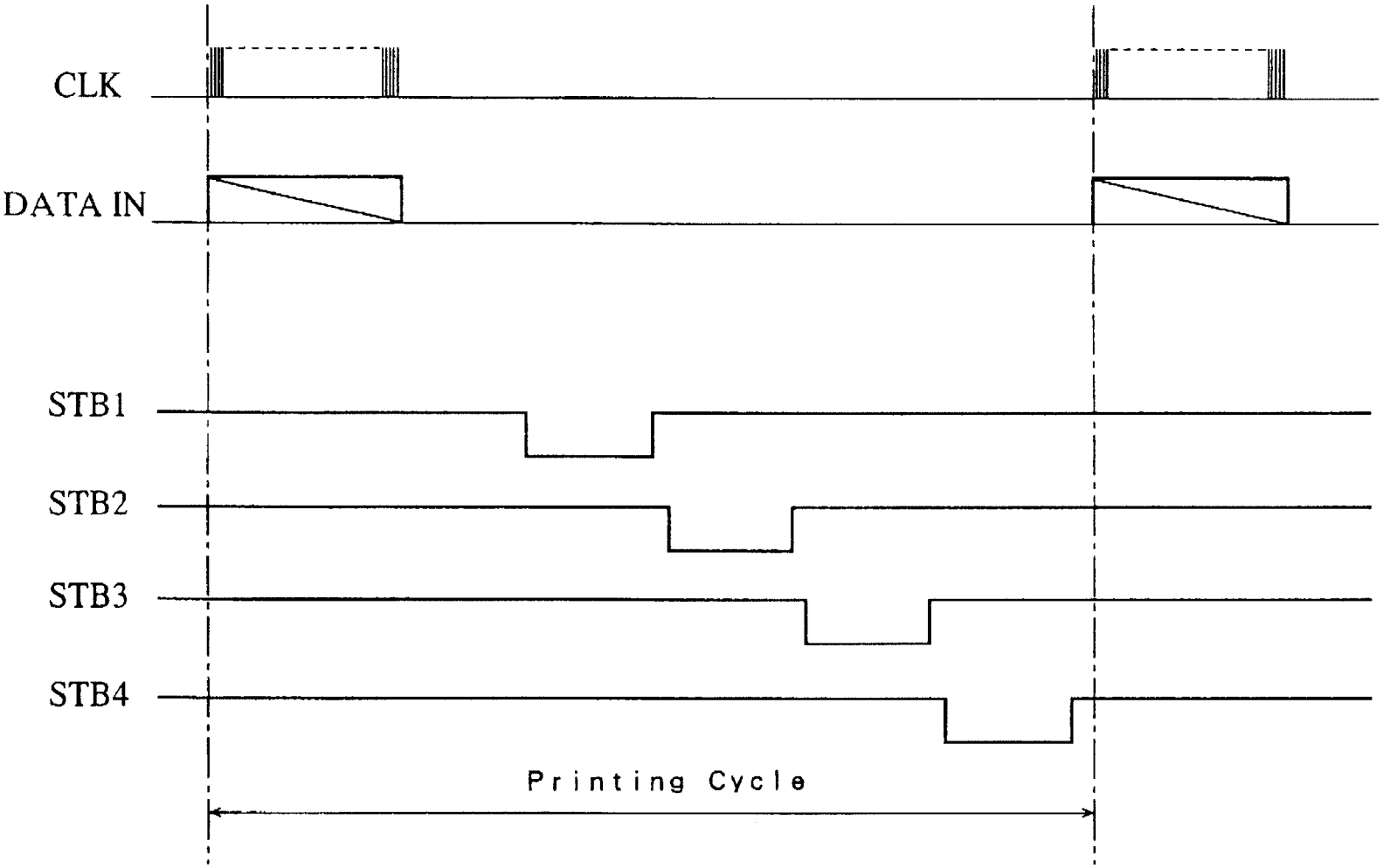
FIG. 4 is a timing chart for performing 4-divisional printing control with respect to the thermal printhead of FIG. 1.

FIG. 4 shows a timing chart for the 4-divisional printing control (FIG. 1*c*). According to clock pulse signals (CLK), 1728-bits printing data are stored in the 1728-bits shift register in all of the drive ICs which are connected in cascade. During a fall time of a first strobe signal STB1, the 1st–432nd heating dots ($D_1$–$D_{432}$) are selectively actuated according to the printing data of the 1st–3rd drive ICs. Next, during a fall time of a second strobe signal STB2, the 433rd–864th heating dots ($D_{433}$–$D_{864}$) are selectively actuated according to the printing data of the 4th–6th drive ICs. Then, during a fall time of a third strobe signal STB3, the 865th–1296th heating dots ($D_{865}$–$D_{1296}$) are selectively actuated according to the printing data of the 7th–9th drive ICs. Finally, during a fall time of a fourth strobe signal STB4, the 1297th–1728th heating dots ($D_{1297}$–$D_{1728}$) are selectively actuated according to the printing data of the 10th–12th drive ICs.

According to the present embodiment, the number of the drive ICs mounted on the head substrate is 12 because an A4-size 1728-dots thermal printhead is actuated with the use of 144-bits drive ICs, as seen in FIG. 1. Since the number 12 can be divided by any of 2, 3 and 4 without a remainder, any of 2-, 3- and 4-divisional printing control modes can be properly performed. In other words, each of the divisional control modes can be performed in a manner such that the number of heating dots in the respective divided groups are equal.

Thus, in the present embodiment, a proper control of printing actuation can be performed regardless of which time-division is selected from the 2-, 3- and 4-divisional modes.

Figure 5:
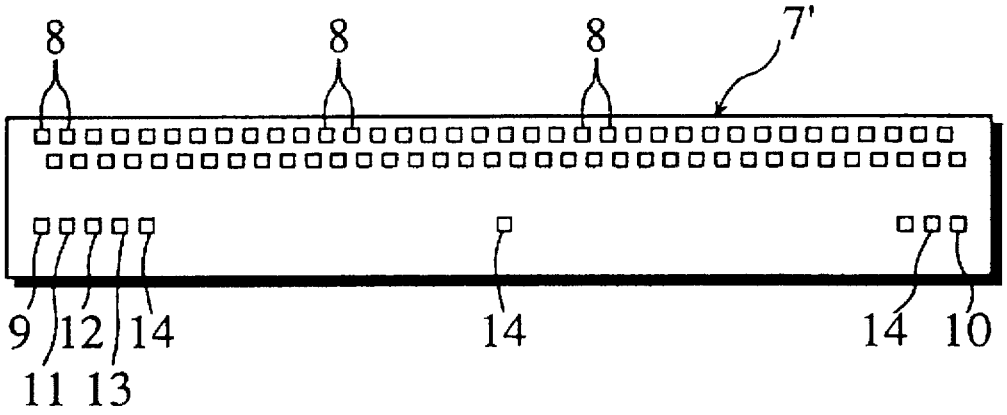
FIG. 5 is an enlarged plan view showing another embodiment of drive IC for a thermal printhead according to the present invention.

Of course, the scope of the present invention is not limited to the embodiment described above. When actuating a 1728-dots A4-size thermal printhead, the number of the output bits of each drive IC may be 48 or 72 for enabling any of 2-, 3- and 4-divisional control modes. FIG. 5 shows an exemplary arrangement of a 72-bits drive IC.

For enabling 2- or 4-divisional control mode, the number of the output bits of each drive IC may be 216 or 432.

Under the current semiconductor manufacturing technique, it is difficult to manufacture a 432-bits drive IC. However, such a drive IC may be realizable in the future. Therefore, theoretically, the scope of the present invention covers a case where a 1728-dots thermal printhead is actuated by four 432-bits drive ICs.

Further, of the embodiments of the drive ICs described above, 144-bits drive ICs 7 can be used in the manners shown in FIGS. 6–9. In the following description with reference to FIGS. 6–9, the same reference signs and expressions as used for the previously described thermal printhead of FIG. 1 are also used for indicating similar elements and for indicating the number of heating dots, and a detailed description therefor will be omitted.

Figure 6:
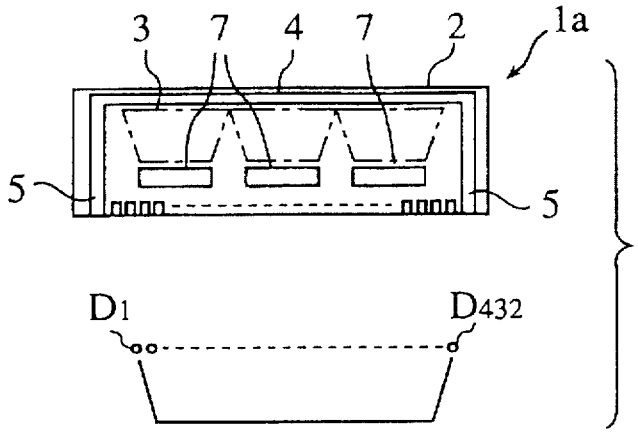
FIG. 6 is a schematic plan view showing the arrangement of a thermal printhead according to another embodiment of the present invention.
Figure 7:
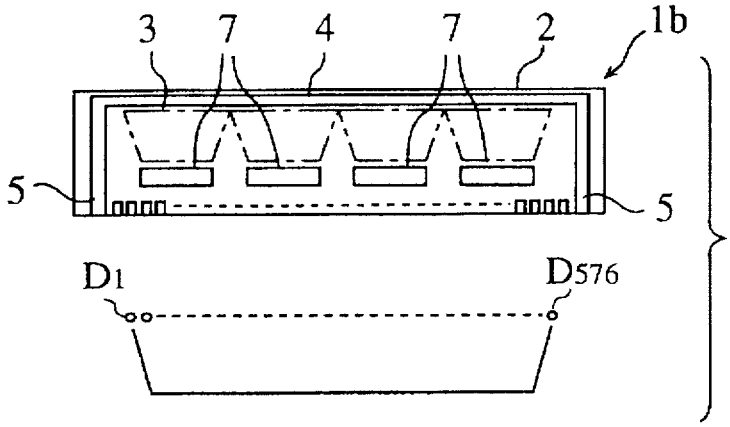
FIG. 7 is a schematic plan view showing the arrangement of a thermal printhead according to a further embodiment of the present invention.
Figure 8:
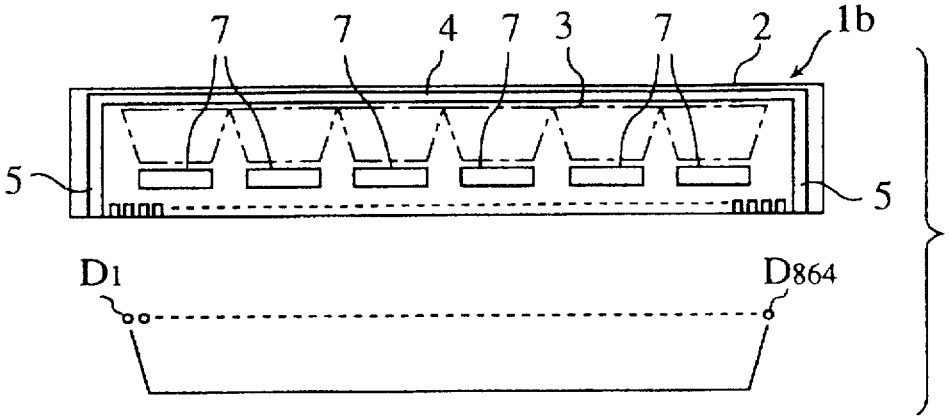
FIG. 8 is a schematic plan view showing the arrangement of a thermal printhead according to still another embodiment of the present invention.

144-bits drive ICs having the same construction as previously described can be used to constitute either a 2-inch size thermal printhead 1*a* as shown in FIG. 6, a 3-inch size thermal printhead 1*b* (actually about 2.7 inch but referred to as "3 inch-size" for convenience) as shown in FIG. 7 or a 4-inch size thermal printhead 1*c* as shown in FIG. 8. In either case (and in the following cases as well), it is premised that the density of the heating dots is 200 dpi. The A4-size thermal printhead 1 corresponds to an 8-inch size one.

More specifically, the 2-inch size thermal printhead 1*a* shown in FIG. 6 incorporates three 144-bits drive ICs 7. Therefore, the total number of output bits is 432 which properly corresponds to the number of heating dots (about 400 for example) needed for a 2-inch size thermal printhead. Such a 2 inch-size thermal printhead may be used for a cash register or for a ticket printer used in railroad vehicles.

The 3-inch size thermal printhead 1*b* shown in FIG. 7 incorporates four 144-bits drive ICs 7. Therefore, the total number of output bits is 576 which corresponds to the number of heating dots (about 540 for example) needed for a 3-inch size thermal printhead. Such a 3-inch size thermal printhead may be used for example as a terminal printer for calculating the gas or water rates.

The 4-inch size thermal printhead 1*c* shown in FIG. 8 incorporates six 144-bits drive ICs 7. Therefore, the total number of output bits is 864 which corresponds to the number of heating dots (about 800 for example) needed for a 4-inch size thermal printhead. Such a 4-inch size thermal printhead may be used as a terminal printer for medical appliances used for taking electrocardiograms or other diagnostic purposes.

As described above, the 144-bits drive ICs 7 conveniently used for the A4-size (8-inch size) thermal printhead 1 are also useful for any of the 2-inch, 3-inch and 4-inch size thermal printheads 1*a*, 1*b*, 1*c*. The 3-inch size thermal printhead 1*b* shown in FIG. 7 can perform 2-divisional control by dividing the drive ICs 7 into two groups each comprising two drive ICs. The 4-inch size thermal printhead 1*c* shown in FIG. 8 can perform 3 or 2-divisional control by dividing the drive ICs 7 into two or three groups each comprising two or three drive ICs. By performing such a divisional control, a large capacity power source is not needed, which is preferable for a handy-type terminal printer. In addition to this, uniform driving control can be realized by equalizing the number of heating dots of the divided groups to eliminate such a disadvantage as irregularity of printing.

Figure 9:
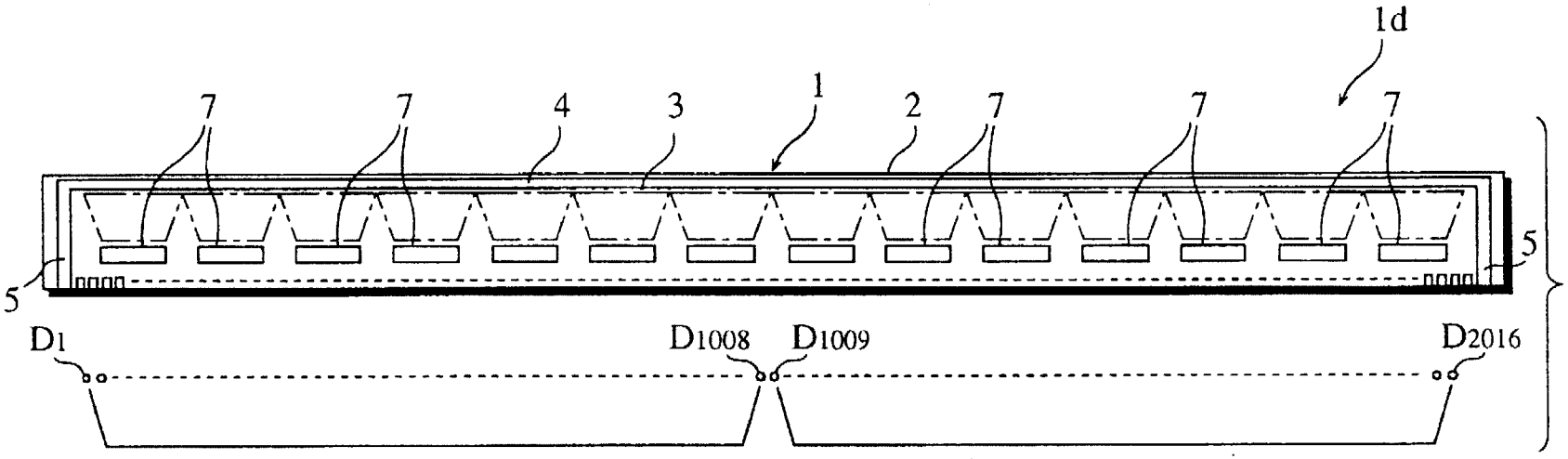
FIG. 9 is a schematic plan view showing the arrangement a thermal printhead according to still another embodiment of the present invention.

FIG. 9 shows a 10-inch size thermal printhead 1*d* which is constructed with the use of fourteen 144-bits drive ICs 7. In this case, the total number of output bits of the fourteen drive ICs 7 is 2016, which corresponds to the number of heating dots (about 2000 dots for example) needed for a 10-inch size thermal printhead. In the embodiment shown in FIG. 9, the thermal printhead 1*d* has two groups each of which comprises 7 drive ICs, so that 2-divisional control can be performed. In this case as well, it is possible to enjoy an advantage that uniform driving control can be realized by equalizing the number of heating dots of the divided groups.

The number of heating dots needed for each of the 2-inch, 3-inch, 4-inch, 8-inch and 10-inch size thermal printheads 1*a*, 1*b*, 1*c* and 1*d* is slightly less than the total number of output bits of the drive ICs mounted on the respective thermal printheads. For example, the number of heating dots needed for the 2 inch-size thermal printhead 1*a* is about 400–420, which is slightly less than the total number of output bits provided by the drive ICs.

If 64-bits drive ICs are used for constituting variously sized thermal printheads, the result is as follows. A 2-inch size thermal printhead requires seven 64-bits drive ICs to provide a total of 448 output bits. A 3-inch size thermal printhead requires ten 64-bits drive ICs to give a total of 640 output bits. A 4-inch size thermal printhead needs thirteen 64-bits drive ICs to provide a total of 832 output bits. A 8-inch size thermal printhead requires twenty-seven 64-bits drive ICs to give a total of 1728 output bits. A 10-inch size thermal printhead needs thirty-two 64-bits drive ICs to give a total of 2048 output bits.

As described above, when using 64-bits drive ICs for constituting variously sized thermal printheads, it is necessary to use 7, 10, 13, 27 or 32 drive ICs. Of these, 7 and 13 are prime numbers, thereby making it impossible to perform a uniform divisional control. Thus, demands for size reduction of the power source or prevention of capacity waste of the power source can not be properly met. By contrast, if use is made of 144-bits drive ICs as in the embodiments of the present invention, these problems will not occur.

Figure 10:
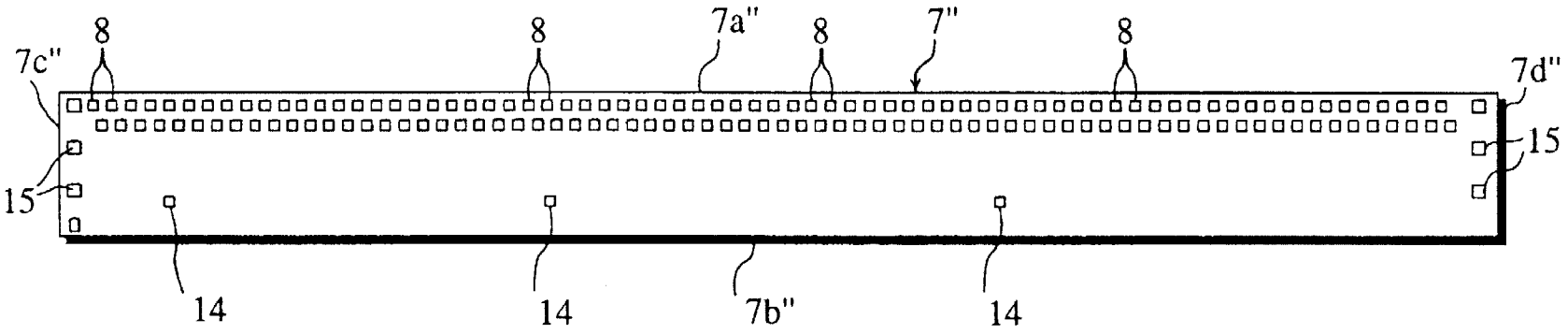
FIG. 10 is an enlarged plan view showing another embodiment of drive IC for a thermal printhead according to the present invention.

FIG. 10 shows a drive IC 7" according to another embodiment of the present invention. The drive IC 7" of this embodiment is in the form of an elongate rectangle having a first longitudinal edge 7*a*", a second longitudinal edge 7*b*", a first short edge 7*c*" and a second short edge 7*d*". The drive IC 7" is similar to the drive IC 7 of FIG. 3 in that 144 output pads 8 are arranged along the first longitudinal edge 7*a*".

However, in the embodiment of FIG. 10, only ground pads 14 are arranged along the second longitudinal edge 7*b*" of the drive IC 7", whereas control signal pads 15 are all arranged adjacent to both of the short edges 7*c*", 7*d*". In other words, in the present embodiment, the ground pads 14 and the control signal pads 15 are arranged distinctly divided regions. The control signal pads 15 include a data-in pad, a data-out pad, a clock pulse input pad, a strobe pad and so forth.

The drive IC 7" of the FIG. 10 embodiment has various advantages. Firstly, since the ground pads 14 and the control signal pads 15 are positioned in the distinctly divided regions, the bonding wires for the ground pads 14 and those for control signal pads 15 are not closely arranged, thereby preventing control signals from being influenced by noises. Secondly, for the same reason as described above, the bonding wires for the ground pads 14 and those for the control signal pads 15 are sufficiently spaced, thereby preventing these kinds of bonding wires from contacting each other and making it possible to correspondingly miniaturize the drive IC 7".

Figure 11:
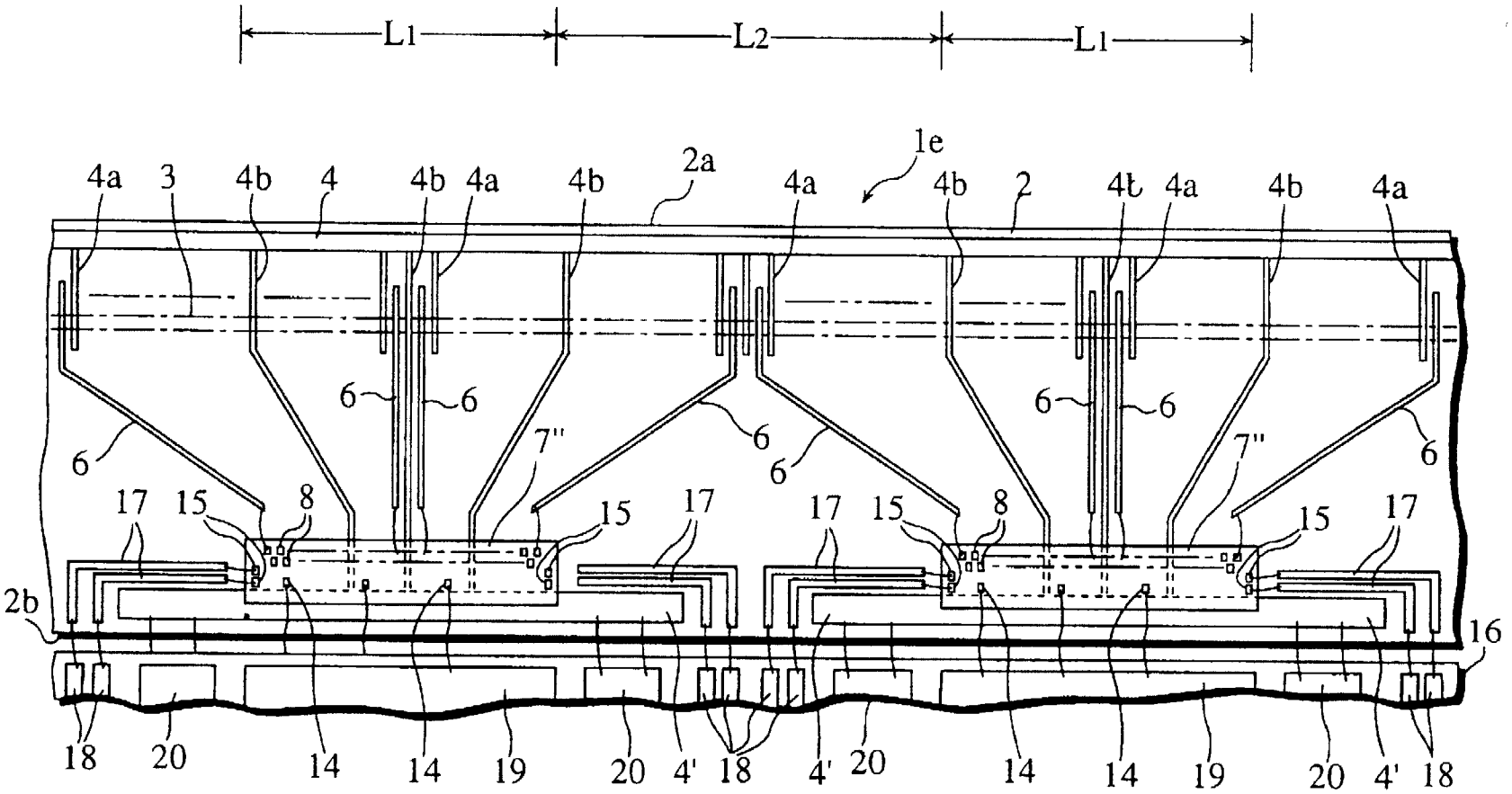
FIG. 11 is an enlarged fragmentary plan view showing a thermal printhead which incorporates the drive ICs of FIG. 10.

FIG. 11 shows an arrangement wherein a plurality of drive ICs 7" each having the same structure as shown in FIG. 10 are mounted in a thermal printhead 1*e*. The thermal printhead 1*e* of FIG. 11 comprises an insulating head substrate 2 and a circuit board 16 which is separate from the head substrate 2.

On the upper surface of the rectangular head substrate 2, a linear heating resistor 3 is formed along one longitudinal edge 2*a* of the substrate, whereas the drive ICs 7" are positioned along the other longitudinal edge 2*b*. A single primary common electrode 4 is located in a strip-like region between the linear heating resistor 3 and the longitudinal edge 2*a* of the substrate 2.

The above-mentioned primary common electrode 4 comprises a plurality of normal comb-like teeth 4*a* which are minutely spaced in the longitudinal direction, and extention teeth 4*b* which are arranged at larger spacing. These teeth 4*a*, 4*b* extend beneath the heating resistor 3. The interval between two adjacent extention teeth 4*b* is preferably set to be about 8 times, for example, as large as the pitch between the normal comb-like teeth 4*a*. Technical meaning of the extention teeth 4*b* will be described later. It should be appreciated that FIG. 11 only shows a limited number of normal comb-like teeth and extension teeth 4*b* for simplification of illustration.

On the other hand, individual electrodes 6 are formed to extend under the heating resistor 3 in staggered relation to the normal comb-like teeth 4*a* and extension teeth 4*b* of the common electrode 4. The individual electrodes 6 included in a group which corresponds to each of the drive ICs 7" extend, in a flaring pattern, from the drive IC 7" to the heating resistor 3. The output pads 8 of the drive ICs 7" are connected to the corresponding individual electrodes 6 by wire bonding.

In the present embodiment, each of the drive ICs 7" has 144-bits (see FIG. 10). Therefore, it is possible to obtain a desired total number of dots with less drive ICs, in comparison with the arrangement which uses typical prior art 64-bits drive ICs. As a result, the spacing between the drive ICs 7" can be rendered larger than conventionally possible. Specifically, the length $L_1$ of the 144-bits drive IC 7" is about 7.8 mm. In this case, the spacing $L_2$ between adjacent drive ICs 7" can be set to be about 10.2 mm, so that $L_2$ is greater than $L_1$. Combined with the arrangement wherein the control signal pads 15 are positioned adjacent to the short edges 7*c"*, 7*d"* of the drive IC 7" (see FIG. 10), the sufficient spacing $L_2$ thus obtained is advantageously used for an advantageous arrangement of a conductor pattern, as described below.

As shown in FIG. 11, in the spacing $L_2$ between adjacent drive ICs 7", there are formed control wiring conductors 17, to which the control signal pads 15 of each drive IC 7" are connected by wire bonding. Under each of the drive ICs 7", a secondary common electrode 4' is formed to protrude largely into the spacing $L_2$.

Each of the extension teeth 4*b* of the primary common electrode 4 extends under a corresponding drive IC 7" for connection to a corresponding secondary common electrode 4'. As a result, the primary common electrode 4 is electrically connected to the secondary common electrode 4' at each of the drive ICs 7".

On the other hand, the circuit board 16 carries control signal connection terminals 18 connected to the control wiring conductors 17 by wire bonding, ground conductors 19 wire-bonded to the drive ICs 7", and a common connection terminal 20 connected to each protruding end portion of each secondary common electrode 4' by wire bonding. As is apparent from FIG. 11, the wires for wire bonding are sufficiently spaced, thereby preventing shorting and the influence of noises on the control signals. Further, the length of the ground conductor 19 can be made generally equal to that of the drive IC 7" to enable passage of a sufficient current.

As described above, the primary common electrode 4 is connected to the secondary common electrodes 4' via the extension teeth 4*b* of the primary common electrode 4. Such an arrangement is technically significant for the following reasons. Specifically, when the total number of heating dots of the thermal printhead 1*e* is large, the voltage drop along the primary common electrode 4 is not negligible to cause a non-negligible difference in generated heat between those heating dots at an end portion of the thermal printhead and those heating dots at a central portion, so that the printing quality may deteriorate. However, with the arrangement shown in FIG. 11, the primary common electrode 4 is electrically connected, via the extension teeth 4*b*, to the secondary common electrodes 4' which are provided for the respective drive ICs 7", thereby preventing the voltage drop along the primary common electrode 4.

Figure 12A:
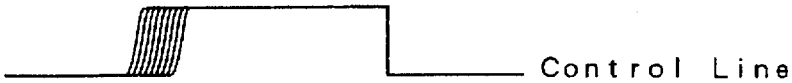
FIGS. 12*a*–12*c* are views illustrating a preferred method for driving the drive IC shown in FIG. 3 or 10.
Figure 12B:
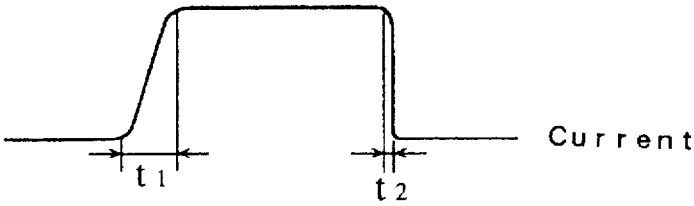
Figure 12C:
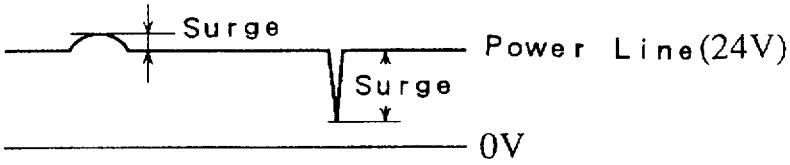
Figure 13:
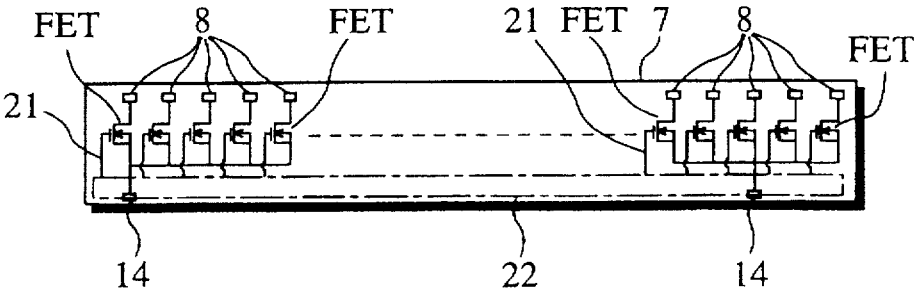
FIG. 13 is a schematic view showing the arrangement of the drive IC used for realizing the driving method shown in FIGS. 12*a*–12*c*.

FIGS. 12*a*–12*c* show a preferred method for driving the drive IC 7 or 7" which has a large number of bits (144 bits for example), as shown in FIG. 3 or 10. FIG. 13 shows the structure of the drive IC used for realizing the method.

In general, a drive IC used for a thermal printhead is designed to operate with a voltage of about 24 V. Considering voltage fluctuations caused by a surge in operation, its maximum tolerable voltage is set at about 32 V, whereas minimum tolerable voltage is set at about −0.7 V. A surge voltage is generated by a sudden change of an electric current, and the surge voltage increases with an increasing rate of change of the electric current. Therefore, the surge voltage becomes higher as the number of output pads of the drive ICs which are simultaneously turned on or off increases. Taking a 144-bits drive IC for example, if all of the 144 bits are turned on, the total electric current is 1152 mA to generate a surge voltage of about 7–8 V since an electric current of 8 mA passes per bit. Therefore, the drive IC designed to operate at a voltage of 24 V has a risk of breaking by an increase of the voltage beyond the maximum tolerable voltage (32 V).

FIG. 13 schematically shows the structure of a drive IC which can overcome the problem described above. Specifically, this drive IC includes a series of switching element FETs which are connected to output pads 8, and the switching element FETs are divided into a plurality of groups for connection to the ground pads 14 by the group. Each of the switching element FETs has a gate connected to a control circuit 22 via a control wire 21. The control circuit 22 includes a shift register for receiving printing data, a latch circuit for holding the printing data, a delay circuit for supplying the printing data to each of the switching element FETs.

With the arrangement describe above, when a set of printing data is supplied for turning on all of the switching element FETs of the drive IC, a printing signal is supplied to each of the switching element FETs in sequence with a slight delay by the action of the delay circuit included in the control circuit 22. On the other hand, a change from the on-state to the off-state is performed simultaneously for all of the switching element FETs.

FIG. 12*a* shows voltage variations at the control wire 21, whereas FIG. 12*b* illustrates variations of the current passing through the drive IC 7. The rising lines minutely spaced in FIG. 12*a* represent control signals at the respective control wires 21. As shown in these figures, a rise time $t_1$ of the electric current is relatively elongated by the action of the delay circuit (which means a low rate of change at the current rise), whereas a fall time $t_2$ of the current is kept short (which means a high rate of change at the current fall).

As a result, a voltage change in the power line is restricted to a small extent at the rise time. Thus, the voltage at the power line is prevented from rising beyond the maximum tolerable voltage.

On the other hand, the surge voltage caused by a sudden fall of the current is −7~8 V which is relatively large. However, since the normal operation voltage of the drive IC is as high as 24 V, it does not fall below the minimum tolerable voltage (−0.7 V). Therefore, there is no need to unduly decrease the operation frequency of the drive IC.

The delay circuit is preferably designed so that the rise time $t_1$ of the current is 100–1350 ns (the rise time and fall time of each switching element FET itself being about 50 ns). Considering the operation frequency of the drive IC, the fall time $t_2$ of the current is preferably set to be no more than 100 ns, particularly no more than 50 ns.

The drive IC according to the present embodiment is so designed that each of the switching element FETs is brought into conduction by supplying a rise signal to the control wire 21 (FIG. 13). However, it is obvious to those skilled in the art that the drive IC may be designed such that each of the switching element FETs is brought into conduction by a fall signal.

The present invention is described above on the basis of the embodiments. However, the present invention is not limited to these embodiments. In particular, the arrangement and driving method illustrated in FIGS. 10–13 are preferable but not essential for the present invention. Therefore, the present invention may be modified in various ways within the scope of the appended claims.

I claim:

1. A drive IC for mounting on a thermal printhead having a predetermined number of heating dots, wherein the drive IC has output bits in a number which is set to be both a divisor of ¼ of the predetermined number of the heating dots and a multiple of 8 no less than 48.

2. The drive IC according to claim 1, wherein the number of output bits of the drive IC is a common divisor of ¼ and ⅓ of the predetermined number of the heating dots.

3. The drive IC according to claim 1, wherein the number of output bits of the drive IC is any one of 72, 122 and 216.

4. The drive IC according to claim 1, wherein the number of output bits of the drive IC is 144.

5. A drive IC for mounting on a thermal printhead which has 1728 heating dots, wherein the drive IC has output bits in a number which is any one of 72, 144 and 216.

6. A thermal printhead comprising a predetermined number of heating dots divided into a plurality of groups, and a plurality of drive ICs for driving the divided groups of heating dots, wherein each of the drive ICs has output bits in a number which is set to be both a divisor of ¼ of the predetermined number of the heating dots and a multiple of 8 no less than 48.

7. The thermal printhead according to claim 6, wherein the number of output bits of each said drive IC is a common divisor of ¼ and ⅓ of the predetermined number of the heating dots.

8. The thermal printhead according to claim 6, wherein the number of output bits of each said drive IC is any one of 72, 144 and 216.

9. The thermal printhead according to claim 6, wherein the number of output bits of each said drive IC is 144.

10. The thermal printhead according to claim 9, wherein the drive ICs are provided in a number which is any one of 3, 4, 6, 12 and 14.

11. The thermal printhead according to claim 6, wherein the heating dots are provided at a dot density of 200 dpi.

12. The thermal printhead according to claim 6, wherein the predetermined number of the heating dots is 1728.

13. The thermal printhead according to claim 6, wherein each said drive IC is elongate and rectangular with two longitudinal edges and two short edges, each said drive IC comprising output pads arranged along one of the longitudinal edges, ground pads arranged along the other longitudinal edge, and control signal pads arranged adjacent to both of the short edges.

14. The thermal printhead according to claim 13, wherein a spacing between adjacent drive ICs is set larger than a length of each said drive IC.

15. The thermal printhead according to claim 13, wherein control wiring conductors are formed between the drive ICs and connected to the control signal pads of each said drive IC by wire bonding.

16. The thermal printhead according to claim 13, wherein a primary common electrode is formed adjacent to the heating dots, a secondary common electrode being formed under each said drive IC to extend beyond the short edges of each said drive IC, the secondary common electrode being electrically connected to the primary common electrode.

17. The thermal printhead according to claim 6, wherein each said drive IC comprises a delay circuit which successively delays an output signal to be supplied to the respective output pads.

18. A method for controlling a thermal printhead which comprises a predetermined number of heating dots divided into a plurality of groups, and a plurality of drive ICs for driving the divided groups of heating dots, wherein each of the drive ICs has output bits in a number which is set to be both a divisor of ¼ of the predetermined number of the heating dots and a multiple of 8 no less than 48, the method comprising: dividing the plurality of drive ICs into 2 or 4 groups; and driving the groups of drive ICs by time division.

19. A method for controlling a thermal printhead which comprises a predetermined number of heating dots divided into a plurality of groups, and a plurality of drive ICs for driving the divided groups of heating dots, wherein each of the drive ICs has output bits in a number which is set to be a common divisor of ¼ and ⅓ of the predetermined number of the heating dots and a multiple of 8 no less than 48, the method comprising:

dividing the plurality of drive ICs into 2, 3 or 4 groups; and driving the groups of drive ICs by time division.

* * * * *